US005318473A

United States Patent [19]

Goemans et al.

[11] Patent Number: 5,318,473

[45] Date of Patent: Jun. 7, 1994

[54] FUME HOOD

[75] Inventors: Josephus H. M. Goemans, Krimpen aan den IJssel; Johannes J. Heere, Heerhugowaard; Peter J. W. Krouwel, Leiden; Ingrid C. M. R. Schuffelers, Rotterdam, all of Netherlands

[73] Assignee: Van Schaik en Berghius B.V., Rotterdam, Netherlands

[21] Appl. No.: 998,616

[22] Filed: Dec. 30, 1992

[30] Foreign Application Priority Data

Jan. 31, 1992 [NL] Netherlands ..... 9200182

[51] Int. Cl.[5] ..... B08B 15/02

[52] U.S. Cl. ..... 454/56

[58] Field of Search ..... 454/56, 62; 312/209, 312/223.6

[56] References Cited

U.S. PATENT DOCUMENTS 2,702,505 2/1955 Nelson ..... 454/62
3,216,630 11/1965 Katzfey et al. .
3,218,953 11/1965 Grow et al. .
3,318,227 5/1967 Nelson et al. ..... 454/62
3,745,908 7/1973 Mayberry ..... 454/62 X
3,956,977 5/1976 Turko et al. ..... 454/56
4,150,606 4/1979 Nelson .

FOREIGN PATENT DOCUMENTS 1183111 3/1970 United Kingdom .

*Primary Examiner*—Harold Joyce
*Attorney, Agent, or Firm*—Westman, Champlin & Kelly

[57] ABSTRACT

A fume hood comprises a back wall (1), two opposed side walls (2), a work table (3) extending between them, an upper part (4) and a movable front sash (5), together defining a working space (6) to which an exhaust device connects. At least one side wall (2) is equipped near its front edge with electrical sockets (8) and with controllable medium outlets (9) opening into the working space (6). The front edges of the side walls (2) comprise separate front posts (7) fixed to the remainder (15) of the side walls (2) and adapted to receive said electrical sockets (8) and medium outlets (9).

9 Claims, 4 Drawing Sheets

FUME HOOD

The present invention relates to a fume hood comprising a back wall, two opposed side walls, a work table extending between them, an upper part and a movable front sash, together defining a working space to which an exhaust device connects, at least one side wall being equipped near its front edge with electrical sockets and with controllable medium outlets opening into the working space.

Such a fume hood is known from U.S. Pat. No. 2,702,505. The fume hood disclosed therein is made completely of sheet metal wherein the side walls are of double structure and consequently the electrical supplies and fluid supply elements are received by and within these side walls.

The object of the present invention is to further improve the fume hood of the type mentioned in the preamble.

For this purpose, the fume hood according to the invention is characterized in that the front edges of the side walls comprise separate front posts fixed to the remainder of the side walls and adapted to receive said electrical sockets and medium outlets.

Due to these separate front posts and concentration of electrical and medium supplies therein, the design of the remaining parts of the fume hood, in particular the side walls thereof, can be more free without limitations in connection with said supplies. The side walls may for instance be made of another material than the front posts while they may also be single-walled thereby creating a greater working space with the same external dimensions.

To obtain an allround and advantageous configuration of the front post it is favourable to form them of extruded sections.

It is also preferred to provide each front post with a front section carrying the sockets and a back section carrying the medium outlets.

The great advantage of this embodiment is that both sections may selectively be combined enabling a large variation with a small number of different sections so that it is easy to comply with certain requirements. It also allows for a good accessibility to the supplies accommodated within the sections.

It is further favourable when each front support comprises a central section to which the front and back sections are fixed and which forms a sealed partition wall, in which the central section is preferably a box section providing strength.

In this way, the central section provides a separation between electrical and medium supplies on the one hand, which contributes to the safety, while the central section renders strength to the front support on the other hand so that in the design of the front and rear sections it is not necessary to pay much attention thereto. As to mounting aspects this embodiment offers the advantage that the major part of the electrical and medium supplies may be mounted to the separate and well accessible sections before the different sections are assembled to the front post. It is noted in this respect that it is of course possible to make the front post—as seen in cross section—from more or less than three sections.

A particular embodiment of the fume hood according to the invention is characterized in that the central section terminates at a distance below the top of the fume hood and wherein within the space of the front post above the central section there is guided a counterweight for the movable sash.

In this manner, the front post also serves for receiving the counter weight of the movable sash. Preferably, the counter weight is positioned and/or dimensioned such that the weight, when it gets loose by accident, can only fall down to the upper end of the central section so that there is no risk of damage to the electrical or medium supplies. It should be noted that the sections are divided lengthwise in pieces, wherein the aligned pieces may have different designs.

Furthermore, it is possible to use one or both front posts for the passage or accommodation of further lines or the like. In this respect, one can think of electric lines for illumination, fans etc.

The invention will hereafter be elucidated with reference to the drawing showing embodiments of the fume hood according to the invention by way of example.

Figure 1:
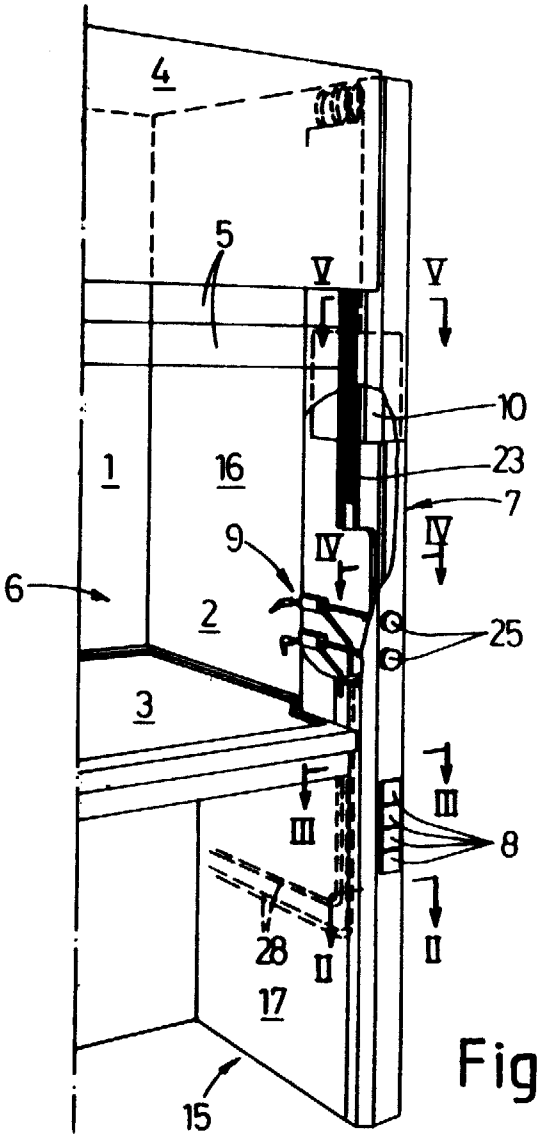
FIG. 1 is a schematical perspective view—partially broken away—of a part of the fume hood according to the invention.

FIG. 1 shows schematically the principal structure of a fume hood comprising a back wall 1, two opposed side walls, of which only one side wall 2 is shown in the drawing, a work table 3 extending therebetween, an upper part 4 which is indicated only schematically, and a movable front sash 5 which has a double structure in this case. Said parts together define a working space 6 to which an exhaust device (not shown) connects which is adapted to exhaust any vapors or gases formed within the fume hood and which might be adapted to render them harmless.

As is visible in FIG. 1, and in particular in the other figures, the side wall 2, and also the opposed side wall (not shown), comprises a separate front post 7 in which a plurality of supplies for the fume hood is accommodated. By concentrating the supplies within the front posts 7 it is not necessary to take these supplies into account when the other parts of the fume hood are designed, so that these parts may be given a construction which is optimal for its proper cause.

FIG. 1 shows schematically a number of supplies accommodated within the front post 7, such as electrical supplies in the form of sockets 8, and medium supplies in the form of line cocks 9 having outlets for water, air, gas etc., for example. Further, there is also received a counter weight 10 for the movable sash 5 within the front post 7, such that it can move up and down in it when the sash 5 is opened or closed.

Referring to FIGS. 2-5, the structure of the front post 7 can be seen better. As shown in particular in FIG. 4, the front post 7 is generally formed of a central section 11, a front section 12 and a back section 13.

The central section 11 is a multiple box section lending strength and rigidity to the front post 7. Furthermore, the central section 11 serves as suspension for the front and back sections 12, 14, such that these front and back sections 12, 13 may be exchanged or demounted independently of each other. The central section 11 is fixed to the remainder 15 of the side wall 2 at 14 by means of fasteners such as screws (not shown). This remainder 15 of the side wall 7 substantially consists of a single-walled panel 16 while below the work table 3 at the inward end of the central section 11 there is fixed an additional wall plate 17 to form a hollow space 18 in the side wall 2. The central section 11 terminates at a distance below the top of the fume hood in order to make room for the counter weight 10 accommodated within the front post 7. The whole front post 7 is divided at a level of the upper ends of the central section 11 by a division line 7' in order to avoid unmanageable long pieces.

Figure 3:
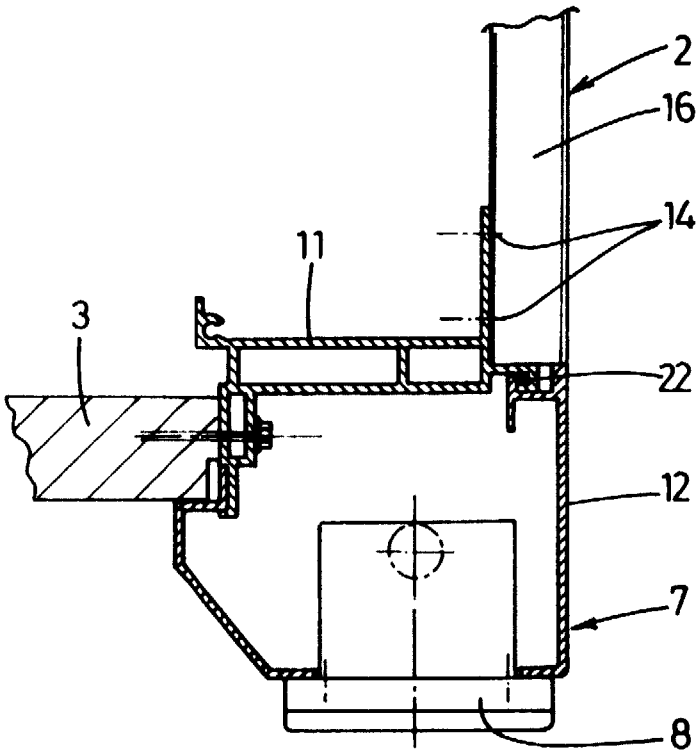
FIGS. 2-5 are enlarged sections along the lines II—II to V—V of FIG. 1.
Figure 2:
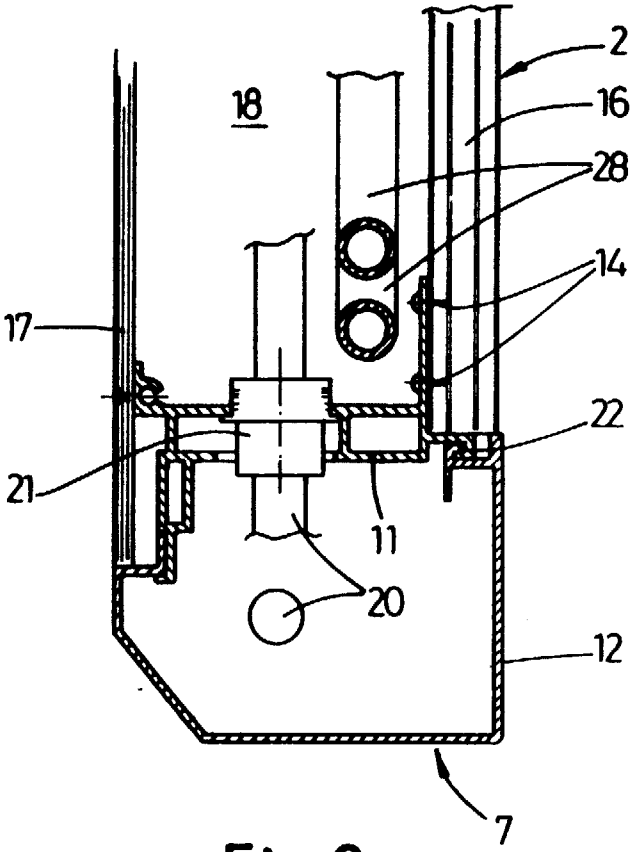

The front section 12 as well as the sections 11 and 13 is an extruded section allowing a great design freedom in cross-section. This front section 12 forms the front side of the side wall 2 of the fume hood on the one hand and defines, together with the central section 11, a hollow space intended to accommodate electrical supplies on the other hand. In FIGS. 2 and 3 and in particular also in FIG. 1 it is shown that a plurality of sockets 19 are inserted through the front wall of the front section 12. These sockets serve for connecting electrical devices used within the fume hood. Electrical lines 20 may for instance extend from the rear side of the fume hood through the hollow space 18 in the side wall 2 forwardly and then guided through a sealed passage 21 into the front section 12 where they are connected to the various sockets 19.

In this embodiment by way of example, the front section 12 has a hook shaped connection to the central section 11 on the outer side at 22, while it is clamped on the opposite inner side below a guide strip 23 for the movable double sash, which guide strip 23 is secured to the central section 11 by screws 24.

The back section 13 is only provided in the area above the work table 3 where, in this case, the line cocks 9 with medium outlets are provided. Then, the back section 13 is intended to accommodate the medium supplies in such a way that the space defined for them is fully separated from the space of the front section 12.

Figure 4:
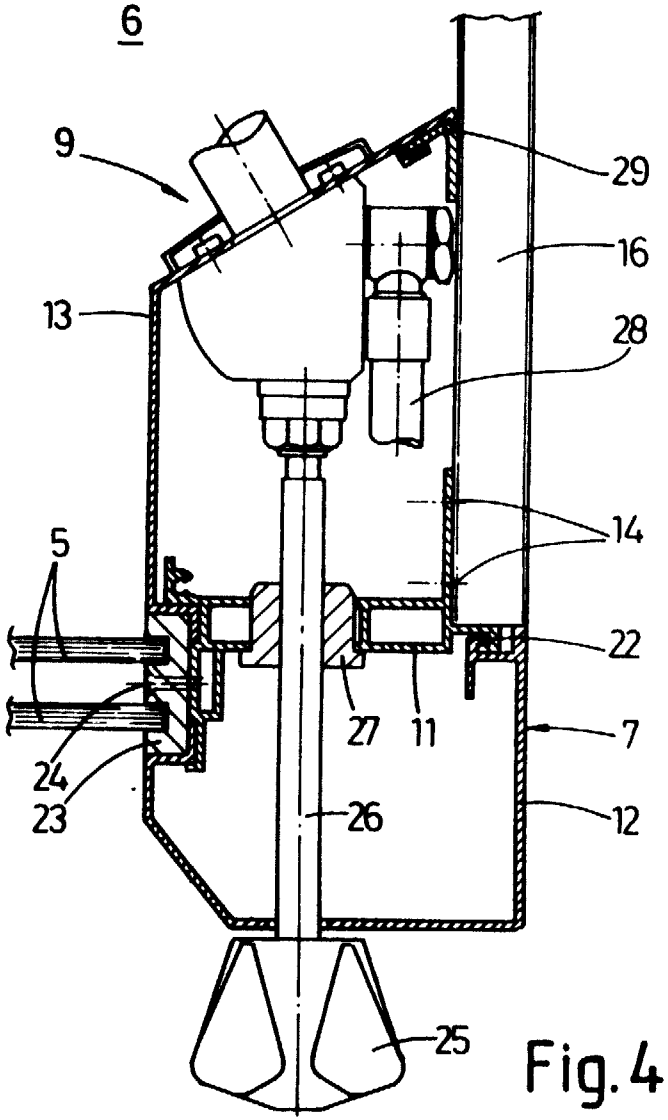

It is shown in FIG. 4 that the line cock 9 is secured to an inclined back wall of the back section 13, so that the medium outlet projects inclined inwardly. The control of the line cock 9 takes place by means of a turning knob 25 which is operatively connected to the line cock 9 through a short control rod 26. For this purpose, the central section has a passage sealed with a sealing means 27 in order to keep the spaces within the front section 12 and the back section 13 separated. A medium line 28 is rotatably connected to the line cock 9 so that the medium line 28 may extend at a favourable angle to the line cock and the lines may extend free from each other through the space within the back section 13 after a short inclined piece. In a position below the work table 3, the medium lines 28 may be bent 90° to the rear in order to extend through the hollow space 18 within the side wall 2 to the back side of the fume hood.

The back section 13 is connected to the panel 16 of the side wall 2 by a hook connection 29 on the one hand and is clamped below the guide strip 23 of the movable sash 5 on the other hand.

Figure 5:
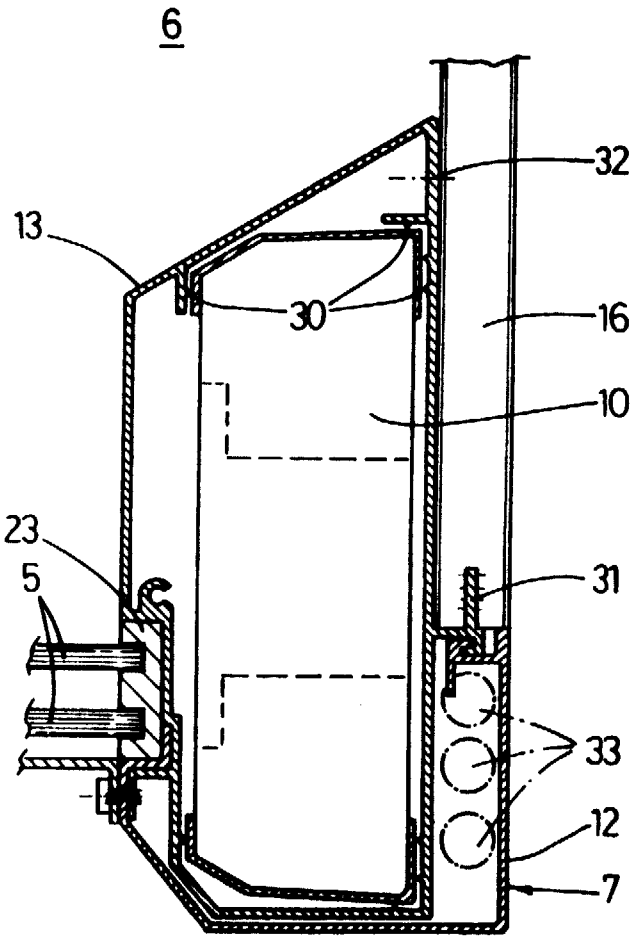

FIG. 5 shows that the front section 12 above the division line 7' is equal to the front section 12 below the division line 7'. On the contrary, the back section 13 is now a fully closed section and includes guide means 13 for guiding the counter weight 10 within this section. Above the division line 7', the back section 13 is fixed to the panel 16 of the side wall 2 by fasteners 31 and 32. In FIG. 1 it is very schematically indicated that the counter weight 10 is suspended from cords extending over pulleys and then being connected to the movable double sash 5.

Figure 8:
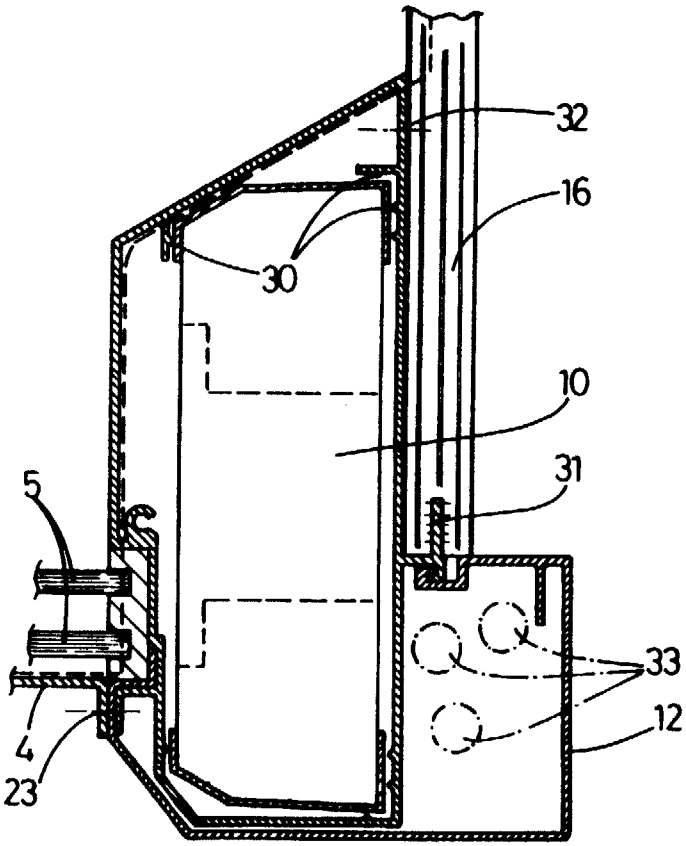
FIGS. 6-8 are sectional views corresponding to those of FIGS. 3-5 showing an alternative for the embodiment of the fume hood of FIGS. 1-5.
Figure 7:
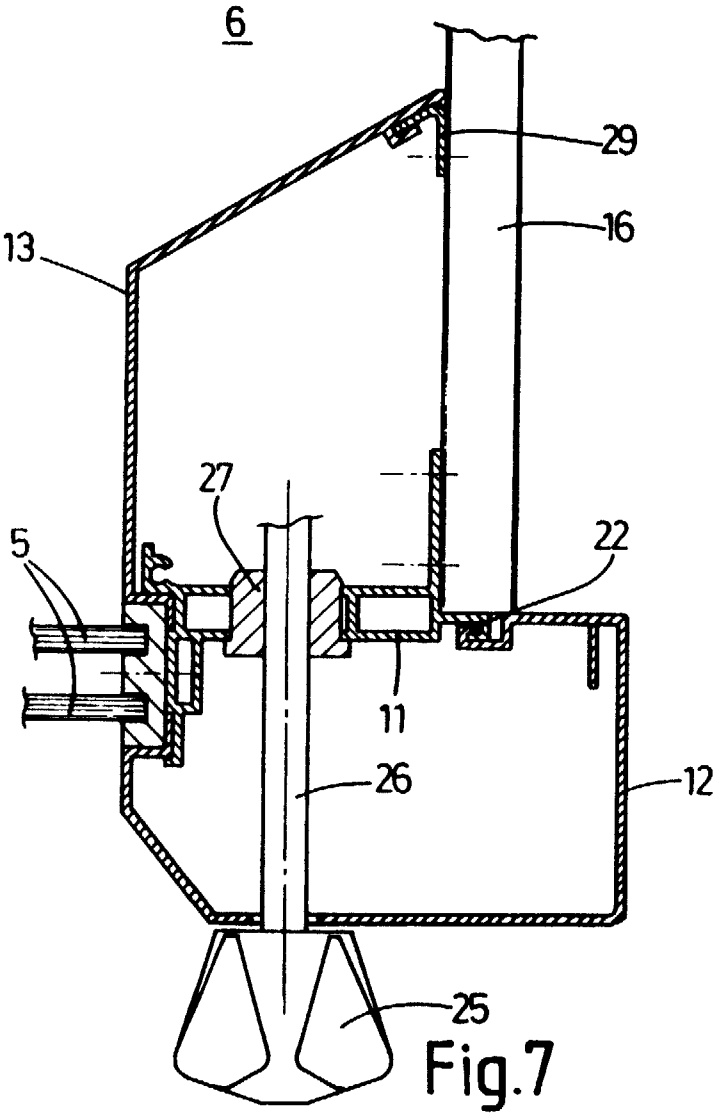
Figure 6:
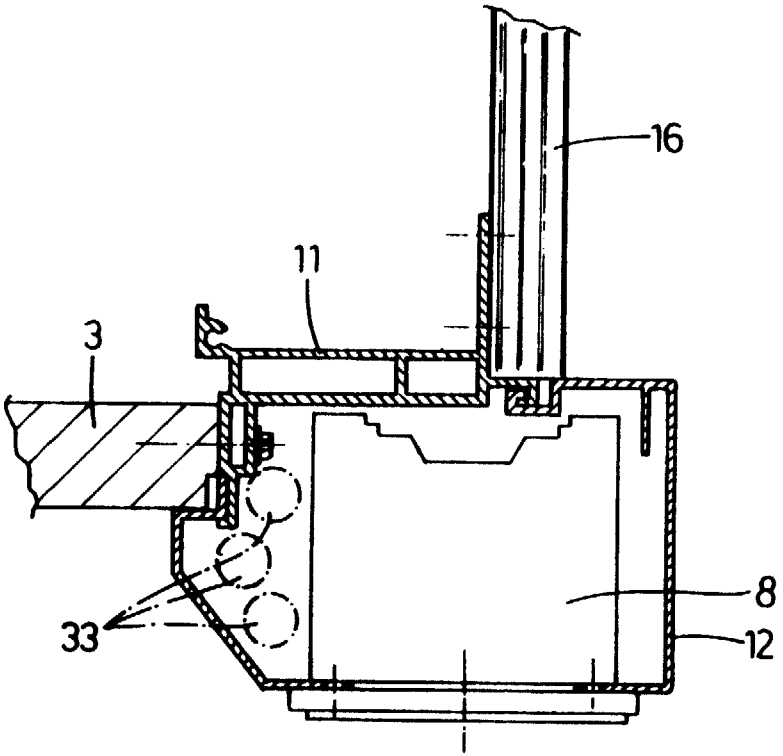

FIGS. 6–8 schematically show an alternative embodiment, in which the front section 12 is wider in order to be able to accommodate larger sockets which are required in some countries. To adapt the fume hood to such requirements it is according to the invention only necessary to exchange the front section, while for the rest there are hardly any changes necessary. This makes the fume hood according to the invention very flexible without involving high costs. In FIGS. 6 and 8, as well as in FIG. 5 there is schematically indicated that free spaces within the front section 12 may be used for the passage of further cables, such as cables for illumination, a fan and the like, which cables are indicated at 33.

The invention is not restricted to the embodiments shown in the drawing and described herein before, which may be varied in different manners within the scope of the invention. The sections of the front post may for instance be shaped in various manners and may also be made in another way than by extrusion. Also the path of the various lines may be adapted to the situation in situ.

We claim:

1. A fume hood comprising a back wall (1), two opposed side walls (2), a work table (3) extending between them, an upper part (4) and a movable front sash (5), together defining a working space (6) to which an exhaust device connects, at least one side wall (2) being equipped near its front edge with electrical sockets (8) and with controllable medium outlets (9) opening into the working space (6), the front edges of the side walls (2) comprising separate front posts (7) fixed to the remainder (15) of the side walls (2) to receive said electrical sockets (8) and medium outlets (9), said front post (7) of said at least one side wall (2) being mounted to the inner side of the remainder (15) of the respective side wall (2) and including a back section (13) containing the medium outlets (9), said medium outlets extending through an oblique back wall of said back section and directly into the working space.

2. A fume hood according to claim 1, wherein the front posts (7) are formed from extruded sections.

3. A fume hood according to claim 1, wherein each front post (7) includes a front section (12) carrying the sockets (8).

4. A fume hood according to claim 3, wherein each front post (7) comprises a central section (11) to which the front and back section (12, 13) are fixed and which forms a sealed partition wall.

5. A fume hood according to claim 4, wherein the central section (11) is a box section providing strength.

6. A fume hood according to claim 4, wherein the central section (11) terminates at a distance below the top of the fume hood and wherein within the space of the front post (7) above the central section (11) there is guided a counterweight (10) for the movable sash (5).

7. A fume hood according to claim 1, wherein lines (20, 28) connected to the sockets (8) and to the medium outlets (9) extend in vertical direction within the front post (7).

8. A fume hood according to claim 1, wherein a remainder (15) of each side wall (2) consists of a thin panel (16) at the level of the working space.

9. A fume hood according to claim 1, wherein the front posts (7) comprise further spaces for vertical passage of further electrical lines (33) such as for illumination and the like.

* * * * *